US008230543B2

(12) United States Patent
Shrier et al.

(10) Patent No.: US 8,230,543 B2
(45) Date of Patent: Jul. 31, 2012

(54) MAKE-UP BRUSHES, THEIR COMPONENTS AND METHODS OF USING THEM

(75) Inventors: Linda Faye Shrier, Omaha, NE (US); David Scott Wood, Plattsmouth, NE (US)

(73) Assignee: Linda Faye Shrier, Omaha, NE (US)

( * ) Notice: Subject to any disclaimer, the term of this patent is extended or adjusted under 35 U.S.C. 154(b) by 834 days.

(21) Appl. No.: 12/256,126

(22) Filed: Oct. 22, 2008

(65) Prior Publication Data

US 2010/0095973 A1 Apr. 22, 2010

(51) Int. Cl.
*A46B 7/04* (2006.01)

(52) U.S. Cl. ..... 15/145; 15/176.1

(58) Field of Classification Search ..... 15/145, 15/176.1–176.6
See application file for complete search history.

(56) References Cited

U.S. PATENT DOCUMENTS

| | | | | | |
|---|---|---|---|---|---|
| 1,082,922 | A | | 12/1913 | Bemis | |
| 2,293,302 | A | | 8/1942 | Morck | |
| 2,426,418 | A | * | 8/1947 | Seaver | 15/176.1 |
| 2,642,610 | A | | 6/1953 | Erik | |
| 2,748,414 | A | * | 6/1956 | Glunt | 15/226 |
| 3,369,265 | A | * | 2/1968 | Halberstadt et al. | 15/22.1 |
| 4,169,297 | A | * | 10/1979 | Weihrauch | 15/145 |
| 4,247,216 | A | * | 1/1981 | Pansini | 403/109.3 |
| 4,471,507 | A | | 9/1984 | Schwartz | |
| 4,605,023 | A | * | 8/1986 | Modin | 15/145 |
| 4,697,949 | A | * | 10/1987 | Perez | 403/361 |
| 5,359,749 | A | | 11/1994 | Chu | |
| 5,435,037 | A | | 7/1995 | Ledingham | |
| 5,598,318 | A | | 1/1997 | Dewitt et al. | |
| 5,752,287 | A | | 5/1998 | Wheat | |
| 5,881,742 | A | * | 3/1999 | Hunsberger | 132/297 |
| 5,887,600 | A | * | 3/1999 | Wilk | 132/262 |
| 5,926,903 | A | | 7/1999 | Kim | |
| 6,014,785 | A | | 1/2000 | Punch et al. | |
| D433,189 | S | | 10/2000 | Schoon et al. | |
| D433,537 | S | | 11/2000 | Schoon et al. | |
| D434,187 | S | | 11/2000 | Schoon et al. | |
| D435,695 | S | | 12/2000 | Schoon et al. | |
| 6,295,685 | B1 | | 10/2001 | Douglas | |
| 6,349,443 | B1 | * | 2/2002 | Randolph et al. | 15/114 |
| 6,367,114 | B1 | | 4/2002 | Babkowski | |
| 6,488,427 | B1 | | 12/2002 | Breidenbach et al. | |
| 6,510,578 | B1 | | 1/2003 | Cry et al. | |
| 6,671,919 | B2 | * | 1/2004 | Davis | 15/167.1 |
| 6,745,427 | B1 | | 6/2004 | Trenz | |
| 7,065,824 | B2 | * | 6/2006 | Petner | 15/145 |
| 7,077,591 | B2 | | 7/2006 | Gueret | |
| 7,159,265 | B2 | * | 1/2007 | Soller et al. | 15/104.94 |
| 7,185,386 | B2 | | 3/2007 | Segrea | |
| 7,287,295 | B2 | | 10/2007 | Treacy et al. | |
| 7,650,662 | B2 | * | 1/2010 | Kakutani | 15/164 |

* cited by examiner

*Primary Examiner* — Mark Spisich
*Assistant Examiner* — Michael Jennings
(74) *Attorney, Agent, or Firm* — Dennis L. Thomte; Thomte Patent Law Office LLC

(57) ABSTRACT

An ornamental design of a make-up brush with a replaceable brush head includes a handle portion having an elongated central axis and a snap fastener. A first portion of the snap fastener is fastened to the handle portion and a second portion of the snap fastener is fastened to a replaceable head. A third portion of the snap fastener includes a push button aligned with the snap fastener along an elongated central axis, wherein the decorative make-up brush is symmetrical. The replaceable head and handle portion are wobble free secured.

3 Claims, 8 Drawing Sheets

MAKE-UP BRUSHES, THEIR COMPONENTS AND METHODS OF USING THEM

BACKGROUND OF THE INVENTION

This invention relates to make-up brushes, and more particularly to disposable make-up brushes, their components, methods of making them and methods of using them.

It is known to provide for replacement of brush heads in make-up brushes. The prior art cosmetic brushes with replaceable heads include a screw attachment fixture to connect the stem to the head. One of the brush head and stem or an attachment to the brush head and stem includes an extending bolt with external threads and the other a hole with internal threads so the two may be threaded together. An example of the prior art cosmetic brushes with a replaceable head is disclosed in U.S. Pat. No. 5,926,903.

The prior art disposable-head cosmetic brushes have several disadvantages, such as: (1) the handle and brush head can only be separated by holding the brush head with one hand and handle with the other in such a position that the bristles of the brush head may cause powder or the like to drop onto or be otherwise deposited onto the user during the removal process; and (2) the action of threading or unthreading the brush head from the handle is relatively slow and tedious and done in a position which could cause cosmetic powders on the head to be inadvertently spread to other surfaces.

It is also known to provide replaceable heads on other non-cosmetic utilitarian devices such as paint brushes or toilet cleaning brushes. In the prior art devices, a replaceable head is insertable into a handle or over the handle. In one type of prior art utilitarian device, the handle and head are held together by members that extend radially from one of the brush head or handle into the other of the brush head or handle to hold the two together. Examples of this type of prior art are shown in the paint brush disclosed in U.S. Pat. No. 6,295,685 and the unidentified brush of the design patent DES. No. 435,695.

The prior art paint brushes or unidentified brushes of this type have a disadvantage of requiring substantial manipulation to enable the radially extending member to be properly insertable into the external member. At best, this connection is not firm because of the difficulty of exerting substantial force radially outwardly into a tightly gripped opening so that for easy insertion, the connections are typically wobbly.

Another type of prior art non-cosmetic utilitarian brush such as a toilet cleaning brush, the replaceable head is held by friction between an external mounting cylindrical sleeve on the head and an inner cylinder on the handle. An actuator at the end of the brush is depressed to release the head. The actuator pushes an external sleeve that is part of the head from the cylinder on the handle to release the head. In embodiments of this type of prior art non-cosmetic utilitarian brush, in addition to a cylindrical sleeve mounting the head by friction against a cylinder on the handle, there is a ball-and-opening detent holding the head to the handle. This prior art type of non-cosmetic utilitarian brush is described in U.S. Pat. Nos. 7,287,295 and 6,745,427.

This type of prior art non-cosmetic utilitarian brush has several disadvantages such as for example: (1) they are not symmetrical but have a handle bent to enable access to difficult places to clean; (2) substantial force is needed to remove the head because of the large frictional area of the sleeve holding the head to the handle and the location of this force at a substantial distance from the center of the structure; and (3) under some circumstances, such as very small brushes, it is unsightly and not easy to use.

Snap-on fasteners are known having a spring formed by an enlarged portion that fits through an opening by changing the dimensions of a spring member and is held by the return of the spring member to its normal dimensions. The prior art snap-on fastener of this type includes an enlarged portion with slots in it extending by an elongated step from a first flat member that is forced through an opening smaller than the enlarged opening in a second flat member. The first and second flat members are separated by a long stem and a fastener on both sides of the second flat member to hold the stem in place and the two flat members do not form a secure wobble free socket suitable for a brush head. One such snap-on fastener is disclosed in connection with FIG. 26 and lines 33 to 50, column 22 of U.S. Pat. No. 5,598,318. This type of snap fastener has not been taught for use in brush holders and has the disadvantage of not providing a support surface to hold the brush from wobbling.

SUMMARY OF THE INVENTION

Accordingly, it is an object of the invention to provide a novel cosmetic brush.

It is a further object of the invention to provide a novel method of applying cosmetics.

It is a still further object of the invention to provide a novel method and brush for avoiding the transfer of harmful materials such as pathological bacteria and the like from one person to another.

It is a still further object of the invention to provide a convenient and inexpensive method of avoiding the use of contaminated products when applying cosmetics.

It is a still further object of the invention to provide a method of applying cosmetics which avoids carry over from a contaminated brush head to the person using the cosmetic applicator.

In accordance with the above and further objects of the invention, an ornamental design is provided for a make-up brush with a replaceable brush head. The make-up brush is symmetrical, attractive, sanitary and easy to use. The replaceable brush head can be quickly and easily connected to the handle or disconnected from the handle. It is connected to the handle by pushing it into a snap-on fastener in the handle and is released from the handle by depressing a push button at the end of the handle. Depressing the push button opens the snap-on fastener.

To permit the easy connection and release of the brush head, the snap-on fastener includes a brush head portion fastened to the brush head and a handle portion fastened to the handle. In the preferred embodiment, the handle portion includes an internal portion within the handle and an external portion extending from the handle. This external portion includes a part of a push button. This part of the push button is the only part of the snap-on fastener external to the make-up brush when the handle and replaceable brush head of the make-up brush are connected together.

The handle has a longitudinal central axis and the push button is positioned at the distal end of the handle aligned with the longitudinal central axis of the handle. The internal portion of the brush head snap-on fastener includes a releasable clamp having a closed position and an open position. With this arrangement, the brush head and handle are held together when the brushed head portion of the snap-on fastener is within the clamp of the handle portion.

The snap-on fastener holds the make-up brush handle and replaceable brush head together securely without wobble. It accomplishes this by including a different one of two complementarily shaped supporting surfaces on each of the brush head and brush handle. The complementarily shaped supporting surfaces engage each other whenever the brush head and handle are snapped together. The complementarily shaped support surfaces have a sufficiently large moment of inertia and are held together with sufficient force by the snap-on fastener so that the ordinary shear forces that are applied between the brush head and the handle in the normal use of the brush cannot separate them nor permit noticeable movement of the brush head with respect to the handle.

In use, make-up is applied to a portion of a body by adhering make-up to a brush head of the make-up brush and at least some of the make-up from the brush head is transferred to the portion of the body. When it is desired to change brush heads for sanitation reasons or to apply a different cosmetic, the brush head may be released by depressing a release button on the end of the handle. After the used brush has been removed, a new brush head may be attached to the handle.

As can be understood from the above description, the make-up brush and method of applying makeup of this invention has several advantages, such as for example: (1) the brush head can be quickly and simply removed by pushing a button at the end of the handle to permit the brush head to drop off for disposal; (2) the brush head can be removed without it moving close to the arm or around the body but can be removed at a distance by pressing the button at the end of the handle with the same hand that is holding the make-up brush; and (3) the brush head can be removed quickly and easily without manipulating that might cause powder or liquid to fall onto the person and be as quickly and easily replaced with a new sterile brush head.

BRIEF DESCRIPTION OF THE DRAWINGS

The above noted and other features of the invention will be better understood from the following detailed description when considered in conjunction with the accompanying drawings, in which.

DETAILED DESCRIPTION

Figure 1:
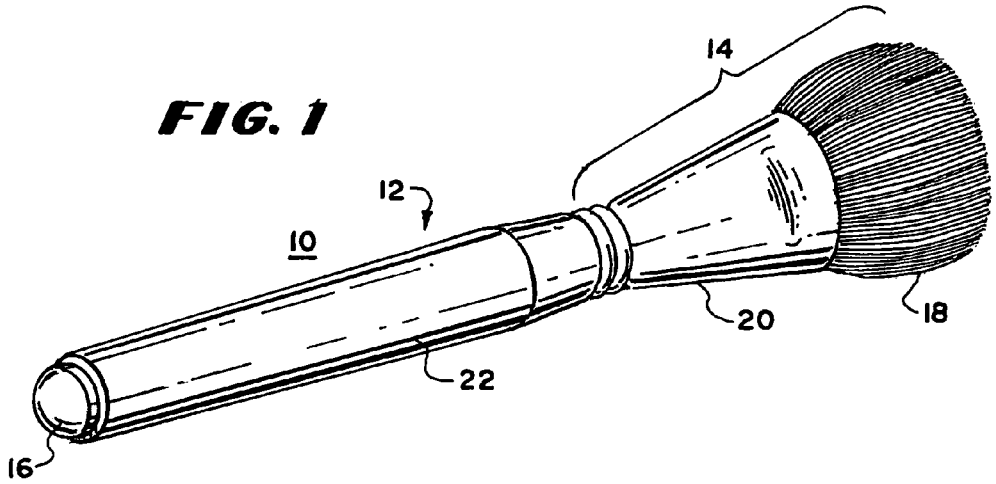
FIG. 1 is a perspective view of an ornamental make-up brush.
Figure 2:
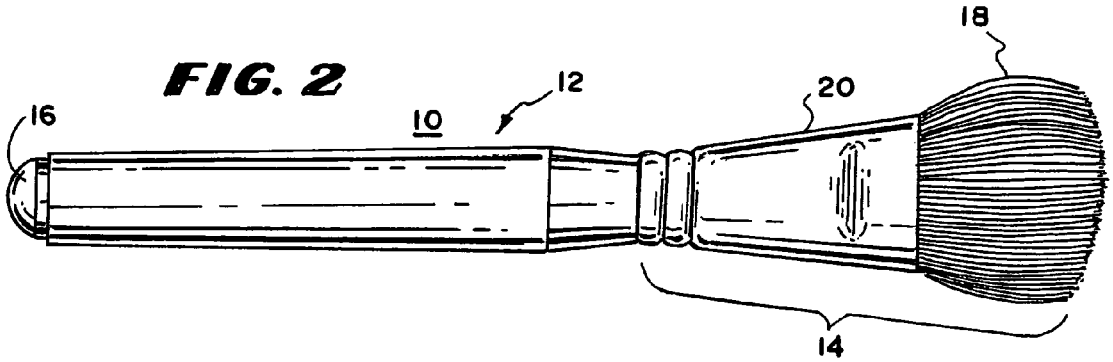
FIG. 2 is an elevational front view of the ornamental make-up brush of FIG. 1.
Figure 3:
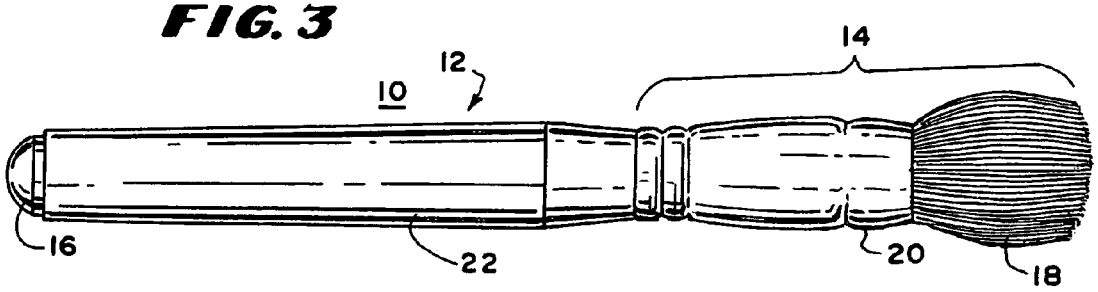
FIG. 3 is a bottom view of the ornamental brush of FIGS. 1 and 2.
Figure 4:
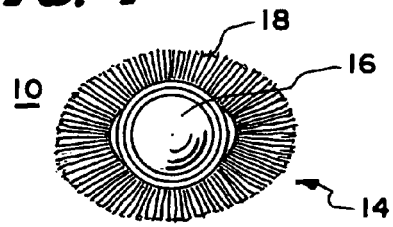
FIG. 4 is a left side bottom view of the ornamental make-up brush of FIGS. 1-3.
Figure 5:
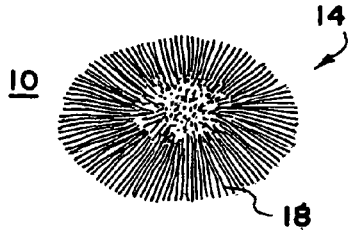
FIG. 5 is a right side top view of the ornamental make-up brush of FIGS. 1-3.
Figure 6:
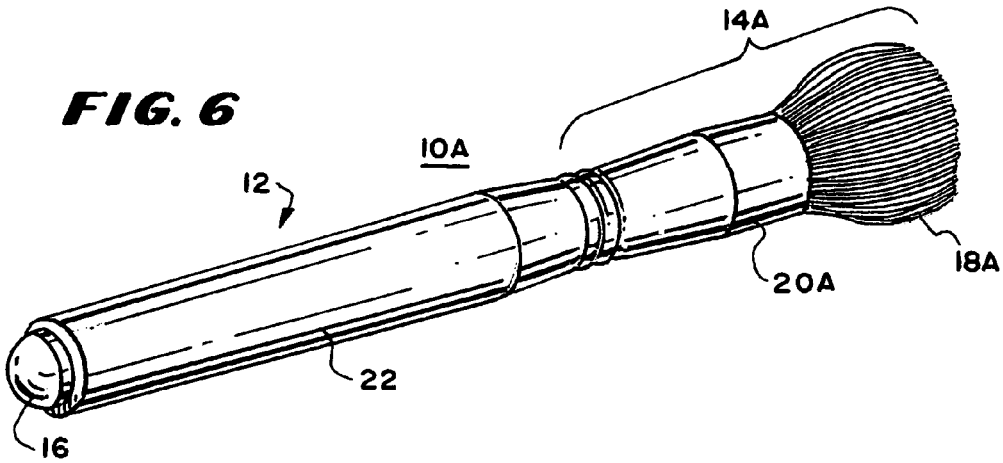
FIG. 6 is a perspective view of another embodiment of ornamental make-up brush.
Figure 7:
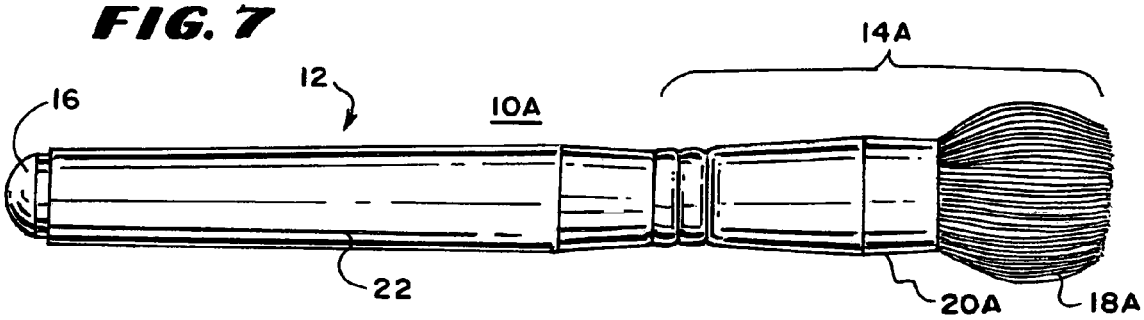
FIG. 7 is an elevational view of the ornamental make-up brush of FIG. 6.
Figure 8:
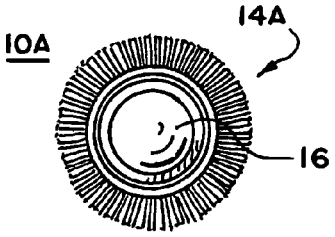
FIG. 8 is a left side bottom view of the make-up brush of FIGS. 6 and 7.
Figure 9:
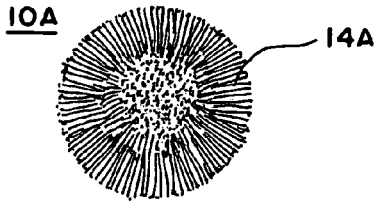
FIG. 9 is a right side top view of the ornamental make-up brush of FIGS. 6 and 7.
Figure 10:
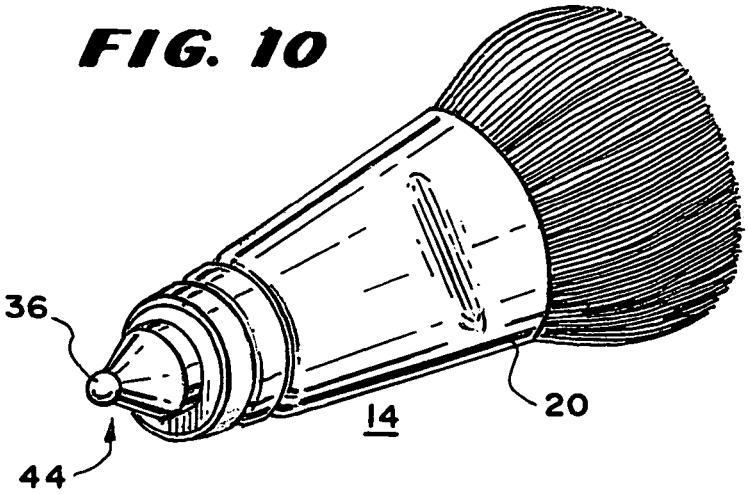
FIG. 10 is a perspective view of one embodiment of an ornamental brush head in accordance with an embodiment of the invention.
Figure 11:
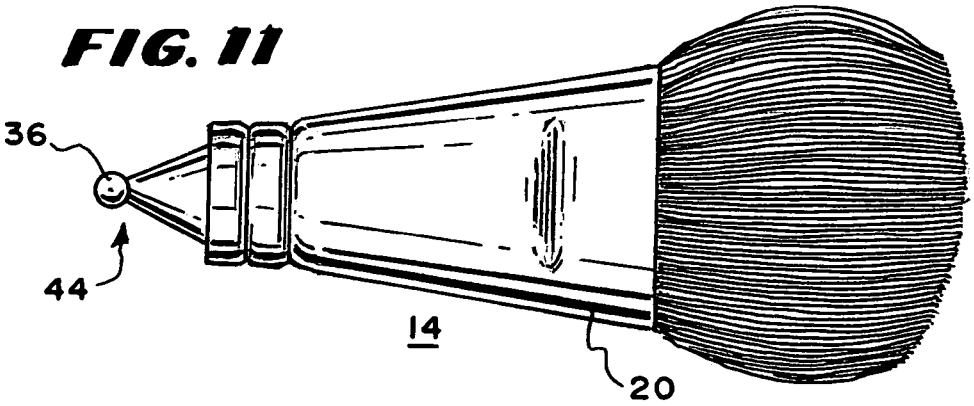
FIG. 11 is an elevational view of the ornamental head of FIG. 10.
Figure 12:
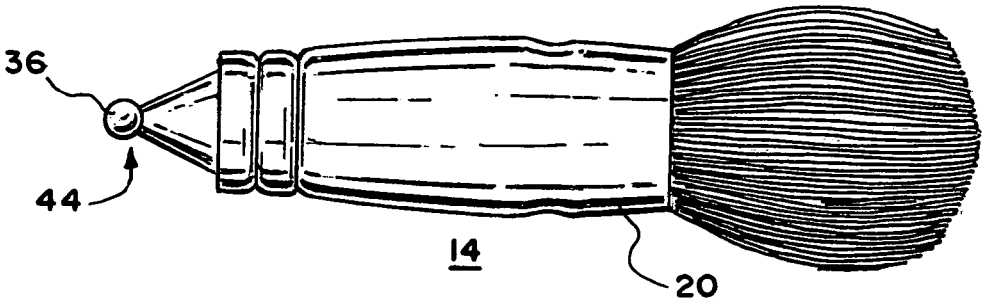
FIG. 12 is a top view of the ornamental brush head of FIG. 10.
Figure 13:
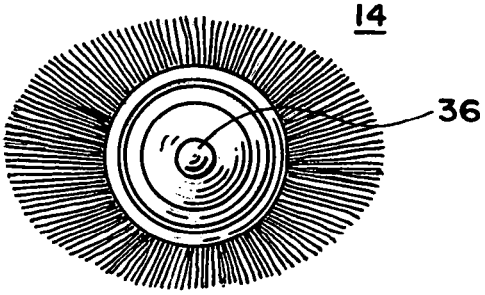
FIG. 13 is a left side bottom view of the ornamental brush head of FIG. 10.
Figure 14:
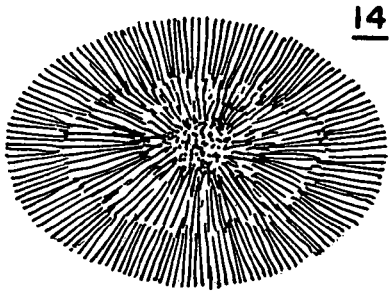
FIG. 14 is a right side top view of the ornamental brush head of FIG. 10.
Figure 15:
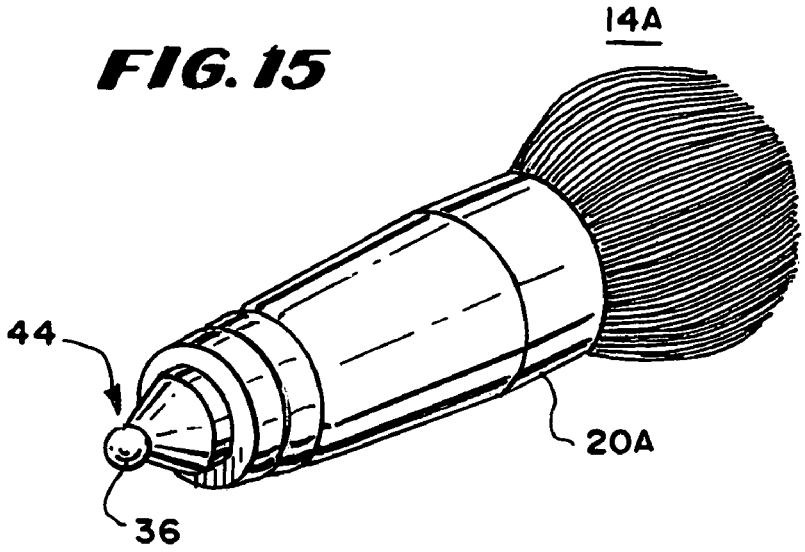
FIG. 15 is a perspective view of another embodiment of ornamental brush head in accordance with an embodiment of the invention.
Figure 16:
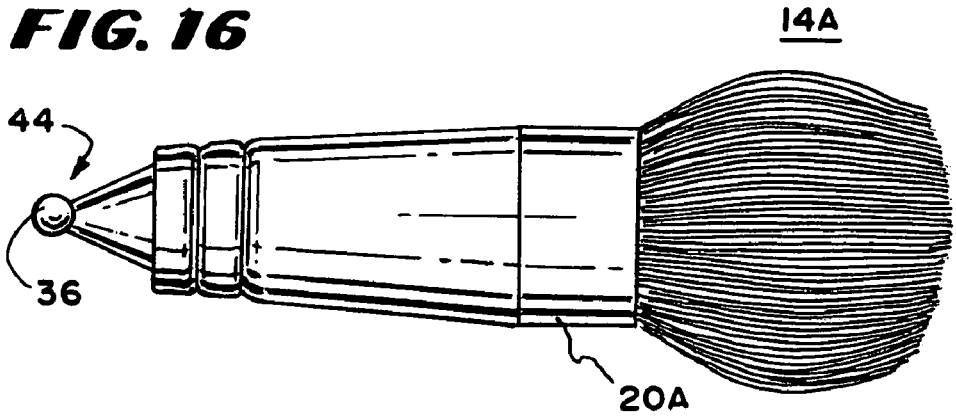
FIG. 16 is an elevational view of the ornamental brush head of FIG. 15.
Figure 17:
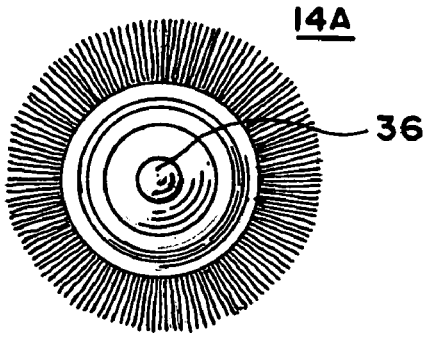
FIG. 17 is a left side bottom view of the ornamental brush head of FIG. 15.
Figure 18:
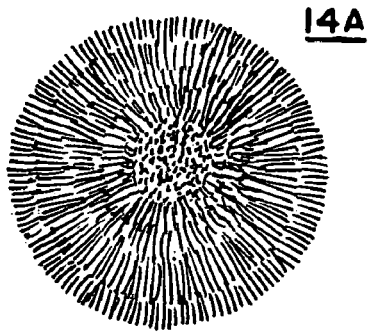
FIG. 18 is a right side view of the ornamental detachable brush head of FIG. 15.

In FIGS. 1-5, there are shown a perspective view, an elevational view, a top view, a left side view and a right side view respectively of a make-up brush 10 having a brush head 14, a stem or handle portion 12 and an actuator button 16. The brush head 14 includes a plurality of bristles shown at 18 held by a ferrule 20. The stem or handle portion 12 includes an outer wall or casing 22 extending from the ferrule 20 to the actuator button 16. In FIGS. 4 and 5, there are shown a plan and bottom of the make-up brush 10. The makeup brush in the embodiment of FIGS. 1-5 provides bristles formed into a narrow somewhat rectangular pattern for application in a narrow line or a wider area. It has the decorative appearance provided by an actuator button 16 on one end, a symmetrical stem 12, a ferrule 20 and bristles 18 on the other end.

In FIGS. 6-9, there are shown a perspective view, an elevational view, a left side bottom view and a right side view respectively of another embodiment of make-up brush 10A having a make-up brush head 14A, a make-up brush stem or handle portion 12 and an actuator button 16. The make-up brush 10A has a stem 12 and an actuator button 16 that are substantially the same as the correspondingly numbered parts in the make-up-brush 10 of FIGS. 1-3 and are indicated by the same reference numerals. However, the head 14A includes a rounded ferrule 20A instead of the crimped ferrule 20 of FIGS. 1-5. The rounded ferrule 20A permits the bristles 18A to have a full curved symmetrical shape as shown in FIGS. 6-9.

In FIGS. 10-14, there are shown a perspective view, an elevational view, a top view, a left side bottom view and a right side view of the brush head 14 of FIGS. 1-5. Similarly, in FIGS. 15-18, there are shown a perspective view, an elevational view, a left side bottom view and a right side view of the brush head 14A.

Figure 19:
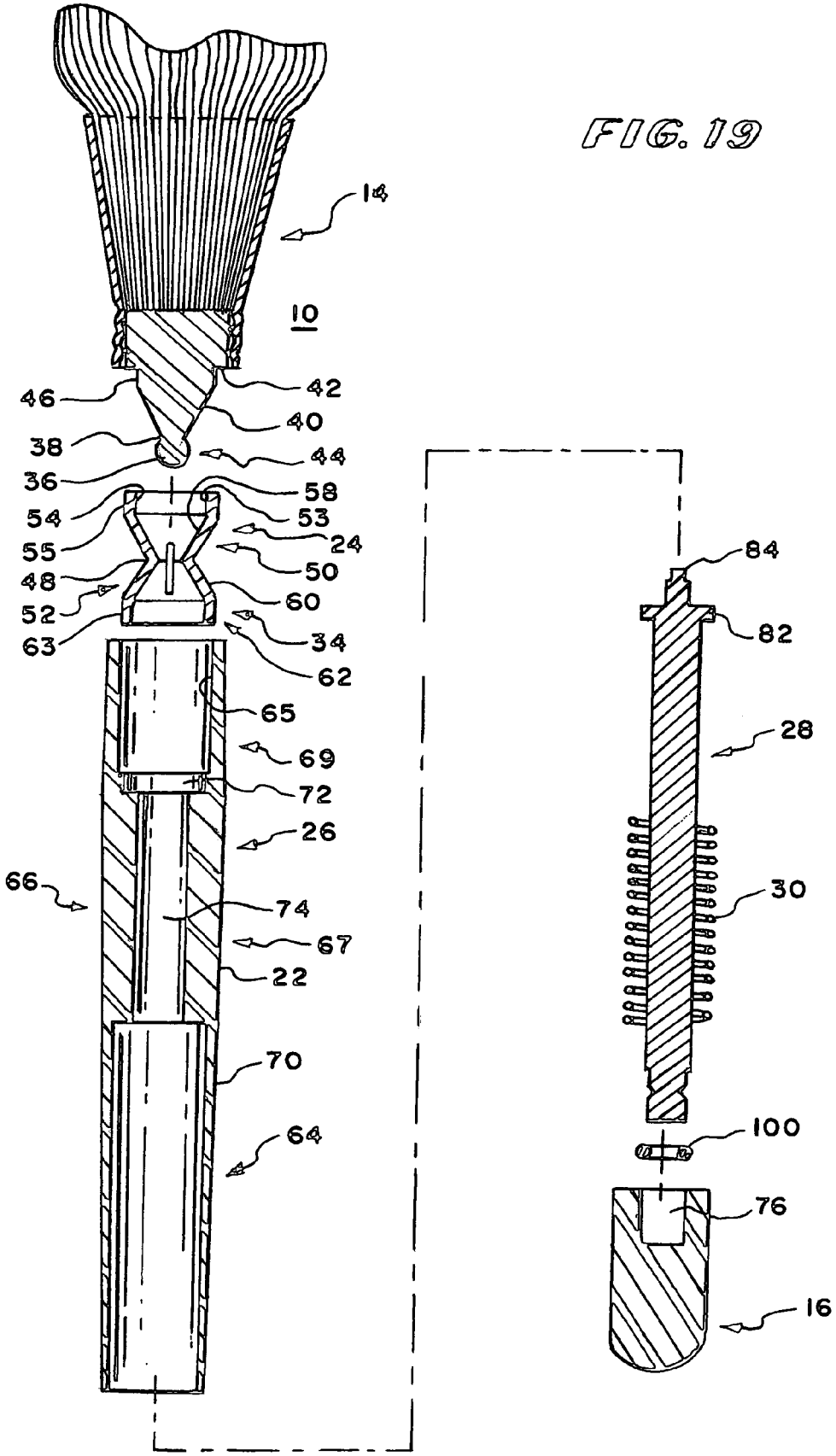
FIG. 19 is a fragmentary exploded sectional view of the make-up brush in accordance with an embodiment of the invention.
Figure 20:
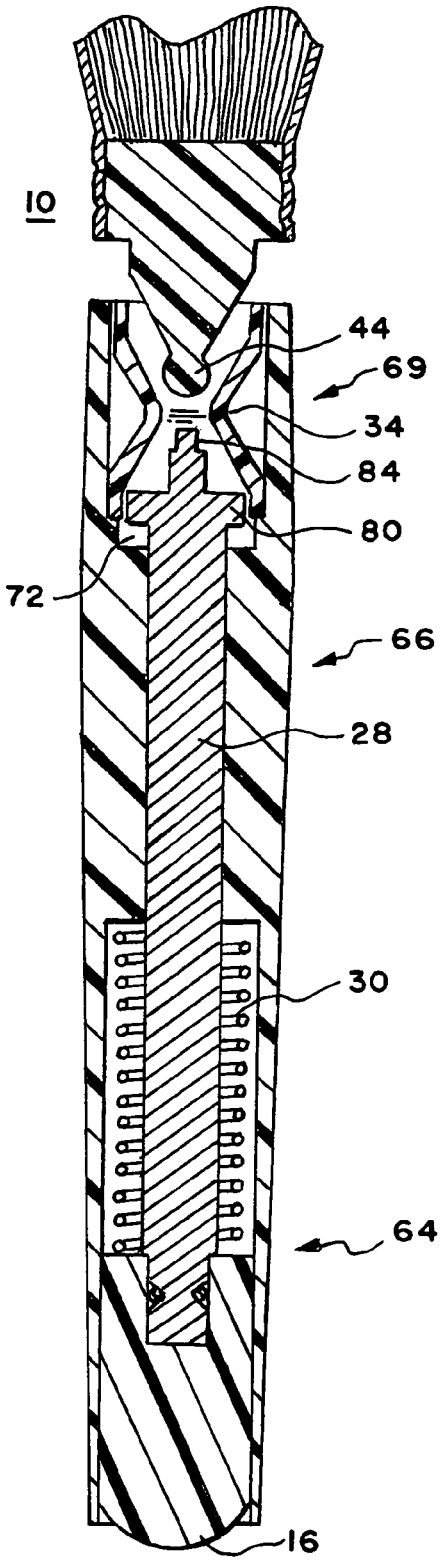
FIG. 20 is a fragmentary sectional view of the make-up brush of FIG. 19.

In FIG. 19 and in FIG. 20, there are shown an exploded elevational view and a longitudinal sectional view respectively of the make-up brush 10 having as some of its principal parts the brush head 14, a clasp 24 (brush head release mechanism), a main tube 26, a push rod 28, a spring 30 and the push button actuator 16. In the preferred embodiment, the clasp 24 (releasable grip) includes a clamp 34 and a detent 44. The detent 44, clasp 24, push rod 28 and push button 16 are parts of a snap lock. The snap lock has a gripping position and a release position that permits the easy replacement of brush heads. In the preferred embodiment, the detent 44 includes a spherical body 36 connected by an annular neck 38 to an inner interfitting conical support 40. The inner interfitting conical support 40 is connected to an annular shoulder 42 by a cylindrical surface 46. In the preferred embodiment, the annular shoulder 42 is part of the replaceable brush head 14.

The clamp 34 includes a support end 50, a release end 52 and an expandable neck 48. The support end 50 includes an annular ledge 53, an inner cylindrical support 54, an outer cylindrical support 55 and a conical inner interfitting socket 58. The annular ledge 53 receives the annular shoulder 42 when the brush head is snapped in place and provides a firm seat against movement. The inner cylindrical support 54 connects the annular ledge 53 to the conical inner interfitting socket 58 and receives the corresponding cylindrical surface 46 of the brush head 14 for further support and the socket 58 receives the conical support 40 to provide further support against wobble. With these support surfaces engaged and held in place by the snap lock, the wobble of the brush during use is not noticeable and is less that five degrees from the central axis in any one direction. In this specification, when the brush head is held to sufficiently large support surfaces sufficiently to avoid movement from the central axis by more than five degrees in any one direction, the brush head and handle are referred to as being wobble free secured.

The inner interfitting conical support surface 40, the outer cylindrical support 55, the annular shoulder 42, the cylindrical surface 46, the annular ledge 53, the inner the cylindrical support 54 and the conical inner interfitting socket 58 are each complementary anti-wobble surfaces. In this specification, complementary anti-wobble surfaces shall be interpreted to be one of at least two surfaces (first and second surfaces), one of which is connected to the brush head 14 and the other of which is connected to the brush handle. Each of the two surfaces has one or more parts fitting one against a corresponding part or parts of the other surface (matching parts). The matching parts are held together by the snap-on fastener when the brush head 14 and handle are snapped together for use. The matching parts are dimensioned so that they are always within their elastic limit when subjected to the largest forces by a user in the course of applying cosmetics. The three factors that control wobble under this condition are the moment of inertia as determined by the size and shape of the matching parts, the modulus of elasticity of the material or materials from which they are made and the force with which they are held together by the snap fastener. These three factors are sufficiently large so that the brush head 14 and the handle do not move with respect to each other noticeably when subjected to the largest forces by a user in the course of applying cosmetics. Generally they will not move more than 1/32 inch with respect to each other under such forces.

The expandable neck 48 includes a cylindrical portion with elongated openings parallel to each other extending in the direction of the axis of the cylinder into the socket 58 on the support end 50 and into the release end 52. These openings reduce the hoop strength sufficiently to permit spring-like expansion of the neck 34 sufficient to permit the spherical body 36 to be forced to the release end 52 of the clamp 34. When the spherical member 36 of the detent is on the release end 52 of the neck 48, the neck 48 closes to hold the brush head 14 in place with wobble security.

The release end 52 of the clamp 34 includes a socket portion 60 and a cylindrical portion 62. The cylindrical portion 62 includes an outer support surface 63 that fits tightly within an inner surface 65 of the outer wall of the main tube 26 to form complimentary supporting surfaces. With this arrangement, the outer support surface 63 of the cylindrical portion 62 and the inner wall 65 of the main tube 26 form anti-wobble surfaces to aid in making the brush head and handle wobble free secured.

The main tube 26 includes a spring compartment section 64, a push rod retention section 67 and a clamp section 66. To retain the push bottom 16 and push rod 28 in place, the push rod retention section 67 includes a bore 72 and a counterbore 74. The bore 72 receives a retaining cylinder 82. The push rod 28 extends to the opposite end where it engages a bore 75 in the push button 16 with a frictional grip such as occasioned with an O-ring 100 in a groove as described hereinafter. The push button 16 includes a spheroid end section 80 and a tip 84 at the other end and has a normal extended position and a depressed release position that releases the brush head. The tip 84 pushes the detent 44 to push it from the clasp 24 and release a brush head.

FIG. 20 best illustrates the manner in which the push rod 28 is seated with it tip 84 positioned to push the detent 44 from the release end 52 of the clasp 24 to release a brush head for replacement. A new brush head may be snapped in place with the detent 44 forcing the neck 48 open until the detent 44 fits on the opposite side, at which time the expandable neck 48 collapses. In this position, the support surfaces of the detent 44 rests within the support surfaces of the clamp 34 to maintain the head stabling in position.

Figure 21:
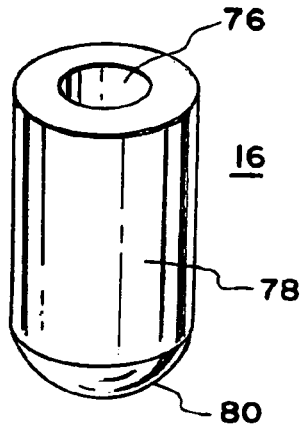
FIG. 21 is a perspective view of a make-up brush handle insert.
Figure 22:
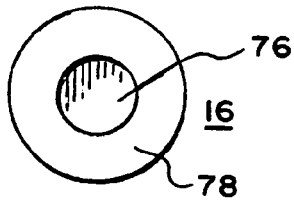
FIG. 22 is a top view of the brush handle insert of FIG. 21.
Figure 23:
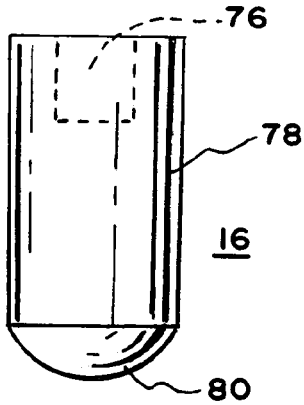
FIG. 23 is an elevational view of the make-up brush handle insert of FIG. 21.

In FIG. 21, there is shown a perspective view of the actuator push button 16 having a cylindrical body 78 with a bore 76 extending into it toward the spheroid end 80 (FIGS. 19 and 20). In FIG. 22, there is shown a top view and in FIG. 23, there is shown an elevational view of the push button actuator 16 illustrating the opening 76 which receives the end of the push rod 28 in frictional engagement. With this arrangement, the push button actuator 16 is held in place for movement with the push rod 28 to release the brush head 14 upon depressing of the spheroidal end 80.

Figure 24:
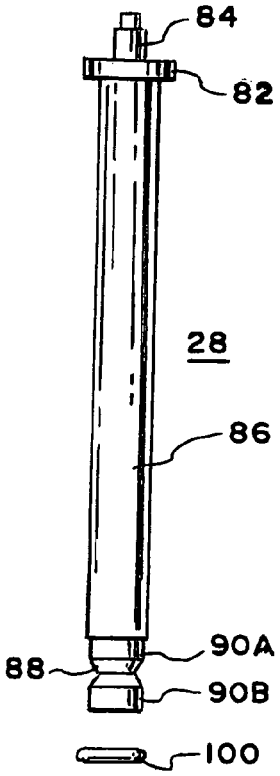
FIG. 24 is a perspective view a make-up brush push rod.
Figure 25:
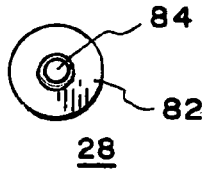
FIG. 25 is a top view of the push rod of FIG. 24.
Figure 26:
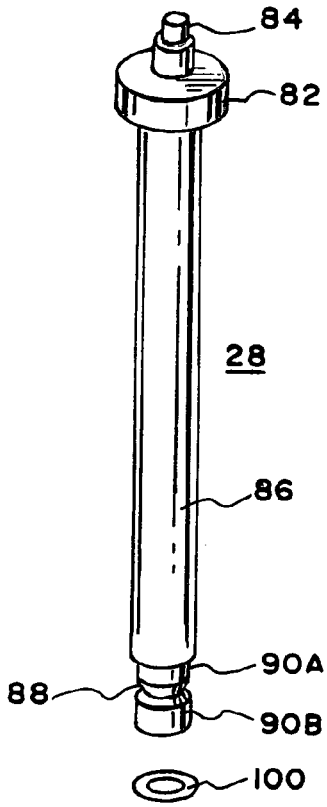
FIG. 26 is an elevational view of the push rod of FIGS. 24 and 25.

In FIG. 24, there is shown a perspective view of the push rod 28 having a tip 84, a rod portion 86, a retaining cylinder 82 and a groove 88. As best shown in the top view of FIG. 25, in the elevational view of FIG. 26, the groove 88 is between top and bottom reduced diameter sections 90A and 90B which fits within the bore 76 (FIGS. 19 and 21-23) of the push button actuator 16 (FIGS. 19 and 21-23) and is held therein by an O-ring 100. It fits within the groove 88. The 0-ring 100 provides friction between the bore 76 and the end of the push rod 28 to retain the push button actuator 16 in place.

Figure 27:
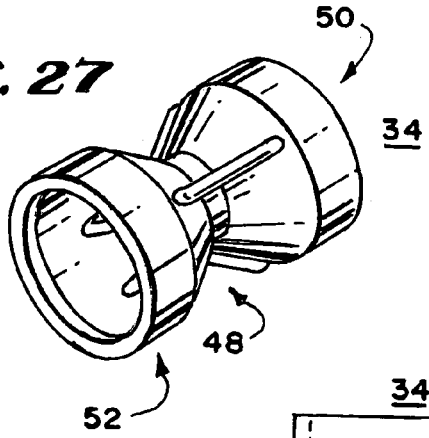
FIG. 27 is a perspective view of a make-up brush restraint.
Figure 28:
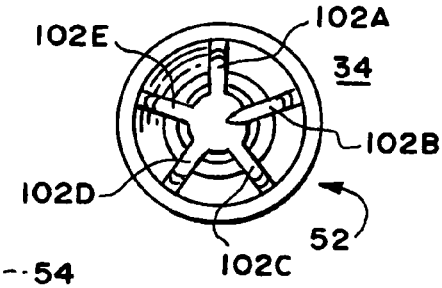
FIG. 28 is a top view of the make-up brush restraint of FIG. 27.
Figure 29:
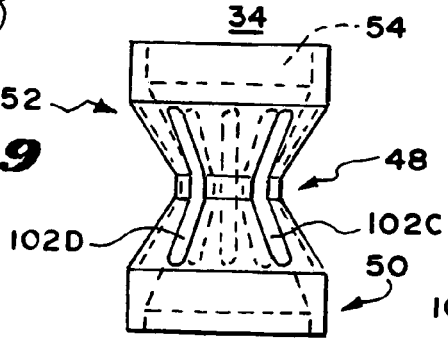
FIG. 29 is an elevational view of the brush restraint of FIG. 27.
Figure 30:
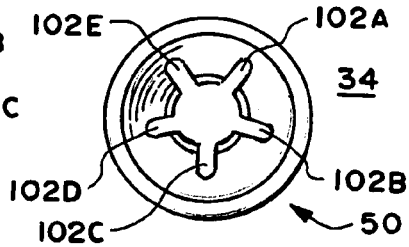
FIG. 30 is a bottom view of the make-up brush restraint of FIGS. 27-29.

In FIG. 27, there is shown a perspective view of the clamp 34 of the snap lock or clasp 24 (FIGS. 19 and 20) having the release end 52, the support end 50 and the expandable neck 48. The support end 50 includes the annular wall 54 (FIGS. 19 and 29) at the top of a right regular cylinder. The inner surface fits against the correspondingly shaped shoulder 42 and the conical support 40 of the detent 44 for stability when the brush head is mounted to the stem. Similarly, the inner surface of a conical expanding neck section 48 receives the conical support wall of the detent 44 for stability. As shown in the top view, the elevational view and the bottom view of FIGS. 28, 29 and 30 respectively, the cylinder 54 is shaped to fit against a corresponding wall in the detent 44 and the similarly shaped release end 50 is shaped to receive and guide the push rod 28 where it may push against the detent 44 and force it through the expandable neck 48 to release the brush head. The expandable neck 48 includes a plurality of slots 102A-102E as shown best in FIGS. 28, 29 and 29 extending from the two cylindrical ends 50 and 52 to permit the neck 48 to expand outwardly so that the detent 44 may pass through it. With this arrangement, the brush head may be located securely in place and, when released, can drop freely into a trash repository or the like. The engagement of the detent 44 provides a snapping action as does its release to permit the user to have the feel of releasing and attaching the brush head. Generally, the push button actuator 16 actuates the push rod 28 from the end of the stem and this can be done with the same hand that holds the make-up brush 10 so that it can be released a distance from the body and even with a trash receptacle to avoid the spreading of makeup that has been adhered to the brush.

Figure 31:
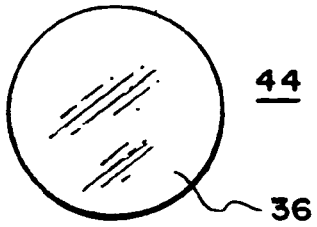
FIG. 31 is a top view of a tapered insert.
Figure 32:
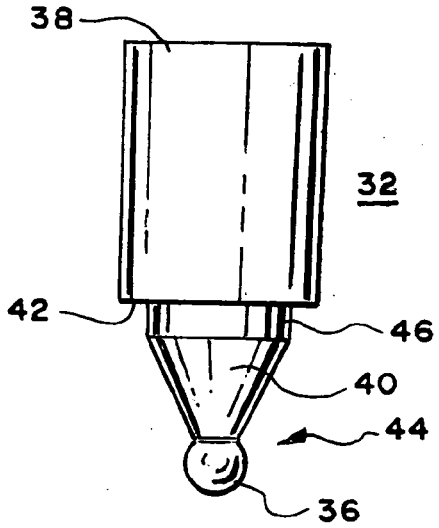
FIG. 32 is an elevational view of the tapered insert of FIG. 31.

In FIGS. 31 and 32, there is shown a top and elevational view of the detent 44 having a cylindrical body 36, ending in an annular shoulder 42 from which a right regular cylinder 38 extends and an inverse cone 40 forming an outer surface complimentary to the inner surfaces of the clasp 24 for support. At the end, the spherical body 36 of the detent 44 extends for gripping at the neck 48 of the clasp 24 to hold the brush head 14 in place.

Figure 33:
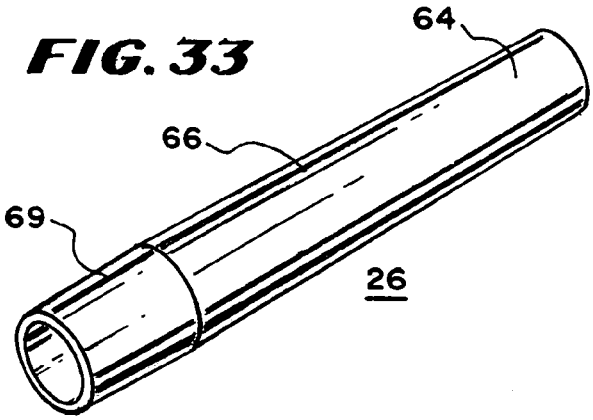
FIG. 33 is a perspective view of the main inner tube of the make-up brush.
Figure 34:
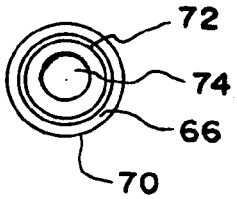
FIG. 34 is a top view of the inner tube of the make-up brush.
Figure 35:
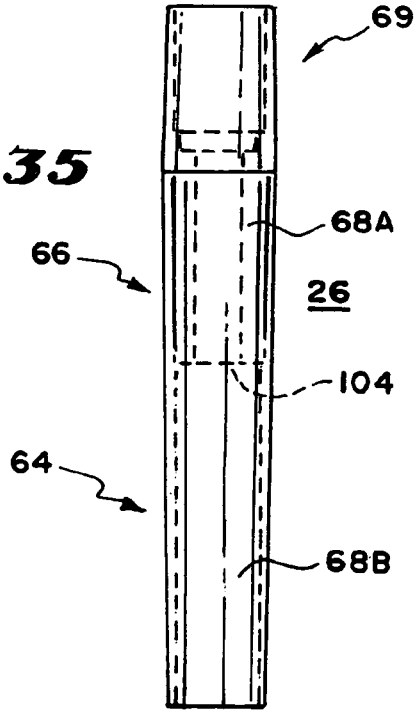
FIG. 35 is an elevational view of the inner tube of the make-up brush.
Figure 36:
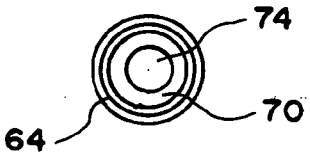
FIG. 36 is a bottom view of the inner tube of the make-up brush.

In FIG. 33, there is shown a perspective view of an embodiment of main tube 26 having a spring compartment section 64, a push rod retention section 66 and a clamp section 69. As shown in the top view of FIG. 34, elevational view of FIG. 35 and bottom view of FIG. 36, the push rod retention section 66 includes a bore 72 and counterbore 74 leading to successively narrow passageways or portions 68A and 68B adapted to receive the rod portion 86 (FIG. 26) of the push rod 28 (FIG. 26) with the cylindrical retaining cylinder 82 fitting within the counterbore 74 to retain the push rod 28 (FIG. 26) in place with its rod portion 86 (FIG. 26) extending through the passageways 68A and 68B separated by a shoulder 104. To insert the push rod, the push rod retention section 66 and spring compartment section 64 may be separated at the shoulder 104 so that the spring portion 64 is connected after the cylinder is within the counterbore 74 to retain the spring 30 in place. With this arrangement, the actuator button 16 is held to the push rod 28 at the end of the spring retention section 64 with limited movement permitted by the range of movement of the retaining cylinder or disk 82 within the counterbore 72.

As can be understood from the above description, the make-up brush and method of applying makeup of this invention has several advantages, such as for example: (1) the brush head can be quickly and simply removed by pushing a button at the end of the handle to permit the brush head to drop off for disposal; (2) the brush head can be removed without it moving close to the arm or around the body but can be removed at a distance by pressing the button at the end of the handle with the same hand that is holding the make-up brush; and (3) the brush head can be removed quickly and easily without manipulating that might cause powder or liquid to fall onto the person and be as quickly and easily replaced with a new sterile brush head.

Although a preferred embodiment of the invention has been described in some particularity, many modifications and variations are possible without deviating from the invention. It is therefore to be understood that the invention may be practiced, within the scope of the appended claims, other than as specifically claimed.

What is claimed is:

1. A make-up brush, comprising:

an elongated handle portion having first and second ends;

said handle portion having an elongated first bore formed therein, having inner and outer ends, extending thereinto from said first end thereof;

said handle portion having an elongated second bore formed therein having first and second ends;

said first end of said second bore being in communication with said inner end of said first bore;

said second bore having a smaller diameter than the diameter of said first bore to form a first annular shoulder at the juncture of said first end of said second bore and said inner end of said first bore;

said handle portion having a third bore, having first and second ends, formed therein;

said first end of said third bore being in communication with said second end of said second bore;

said third bore having a greater diameter than said second bore to form a second annular shoulder at the juncture of said second end of said second bore and said first end of said third bore;

said handle portion having a fourth elongated bore, having inner and outer ends, formed therein;

said inner end of said fourth bore communicating with said second end of said third bore;

said fourth bore having a greater diameter than the diameter of said third bore to form a third annular shoulder at the juncture of said second end of said third bore and said inner end of said fourth bore;

a generally hour-glass shaped clamping member having inner and outer ends;

said clamping member including:

(a) a first cylindrical wall portion at said inner end thereof which has first and second ends;

(b) a generally truncated conical-shaped wall portion having a first end, a second end, an inner wall surface and an outer wall surface;

(c) said first end of said generally truncated conical-shaped wall portion of said clamping member being joined to said second end of said first cylindrical wall surface of said clamping member;

(d) an inverted truncated, generally conical-shaped wall portion having a first end, a second end, an inner wall surface and an outer wall surface;

(e) said first end of said inverted truncated, conical-shaped wall portion being joined to said second end of said truncated, conical-shaped wall portion to form a generally circular socket receiving portion;

(f) a second cylindrical wall portion at said outer end of said clamping member which has first and second ends;

(g) said first end of said second cylindrical wall portion being joined to said second end of said inverted truncated conical-shaped wall portion;

said clamping member being positioned in said fourth bore so that said first end of said first cylindrical wall portion of said clamping member engages said third annular shoulder of said handle portion;

an elongated push rod having first and second ends;

said push rod selectively movably extending through said first bore, said second bore, said third bore and said fourth bore in said handle portion;

said push rod being longitudinally movable between first and second positions;

said push rod having an enlarged head portion thereon which is spaced from said second end thereof;

said enlarged head portion of said push rod being in engagement with said second shoulder of said handle portion when said push rod is in said first position;

said second end of said push rod having a tip portion extending from said head portion of said push rod;

said tip portion of said push rod being spaced from said socket receiving portion when said push rod is in said first position;

said tip portion of said push rod extending into said socket receiving portion when said push rod is in said second position;

an actuator button, having outer and inner ends, positioned in said first bore of said handle portion at said first end of said handle portion;

said actuator button being selectively longitudinally movable in said first bore of said handle portion;

said inner end of said actuator button being secured to said first end of said push rod;

said outer end of said push button extending outwardly from said first end of said handle portion;

a spring means in said first bore of said handle portion which yieldably maintains said push rod in said first position;

a brush head including a ferrule having an inverted, truncated conical-shaped portion, having first and second ends, and a generally cylindrical portion at said first end of said inverted truncated conical-shaped portion thereof;

said ferrule having a plurality of bristles received therein which extend outwardly therefrom;

a detent assembly including first and second ends;

said detent assembly having a first generally cylindrical portion, having first and second ends; which is received by said cylindrical portion of said ferrule;

said detent assembly also having a second generally cylindrical portion at said first end of said first cylindrical portion which has a diameter less than said first cylindrical portion of said detent assembly to form a shoulder at the juncture of said first and second cylindrical portions thereof;

said detent assembly also having an inverted, conical-shaped portion, having first and second ends, which extends from said first end of said second cylindrical portion thereof;

said detent assembly having a detent ball at said first end of said inverted, conical-shaped portion thereof;

said brush head being selectively removably attachable to said clamping member;

said detent ball extending through said socket receiving portion of said clamping member when said brush head is attached to said clamping member;

said shoulder of said detent assembly engaging said outer end of said second cylindrical wall portion of said clamping member when said brush head is attached to said clamping member;

said second cylindrical portion of said detent assembly being received by said second cylindrical wall portion of said clamping member when said brush head is attached to said clamping member;

said inverted conical portion of said detent assembly being in engagement with said inner wall surface of said inverted conical-shaped wall portion of said clamping member when said brush head is attached to said clamping member;

said tip portion of said push rod being movable into engagement with said detent ball to push said detent ball out of engagement with said socket receiving portion to disconnect said brush head from said handle portion when said push rod is moved, by inward movement of said actuator button with respect to said first bore of said handle portion, from said first position to said second position.

2. A make-up brush, comprising:

an elongated handle portion having first and second ends;

said handle portion having an elongated first bore formed therein, having inner and outer ends, extending thereinto from said first end thereof;

said handle portion having an elongated second bore formed therein, having first and second ends;

said first end of said second bore being in communication with said inner end of said first bore;

said second bore having a smaller diameter than the diameter of said first bore to form a first annular shoulder at the juncture of said first end of said second bore and said inner end of said first bore;

said handle portion having a third bore formed therein, having first and second ends, said first end of said third bore being in communication with said second end of said second bore;

said third bore having a greater diameter than said second bore to form a second annular shoulder at the juncture of said second end of said second bore and said first end of said third bore;

said handle portion having a fourth elongated bore, having inner and outer ends, formed therein;

said inner end of said fourth bore communicating with said second end of said third bore;

said fourth bore having a greater diameter than the diameter of said third bore to form a third annular shoulder at the juncture of said second end of said third bore and said inner end of said fourth bore;

a generally hour-glass shaped clamping member having inner and outer ends;

said clamping member including:

(a) a first wall portion at said inner end thereof which has first and second ends;

(b) a generally truncated conical-shaped wall portion having a first end, a second end, an inner wall surface and an outer wall surface;

(c) said first end of said generally truncated conical-shaped wall portion of said clamping member being joined to said second end of said first wall surface of said clamping member;

(d) an inverted truncated, generally conical-shaped wall portion having a first end, a second end, an inner wall surface and an outer wall surface;

(e) said first end of said inverted truncated, conical-shaped wall portion being joined to said second end of said truncated, conical-shaped wall portion to form a generally circular socket receiving portion;

(f) a second wall portion at said outer end of said clamping member which has first and second ends;

(g) said first end of said second wall portion being joined to said second end of said inverted truncated conical-shaped wall portion;

said clamping member being positioned in said fourth bore so that said first end of said first wall portion of said clamping member engages said third annular shoulder of said handle portion;

an elongated push rod having first and second ends;

said push rod selectively movably extending through said first bore, said second bore, said third bore and said fourth bore in said handle portion;

said push rod being longitudinally movable between first and second positions;

said push rod having an enlarged head portion thereon which is spaced from said second end thereof;

said enlarged head portion of said push rod being in engagement with said second shoulder of said handle portion when said push rod is in said first position;

said second end of said push rod having a tip portion extending from said head portion of said push rod;

said tip portion of said push rod being spaced from said socket receiving portion when said push rod is in said first position;

said tip portion of said push rod extending into said socket receiving portion when said push rod is in said second position;

an actuator button, having outer and inner ends, positioned in said first bore of said handle portion at said first end of said handle portion;

said actuator button being selectively longitudinally movable in said first bore of said handle portion;

said inner end of said actuator button being secured to said first end of said push rod;

said outer end of said push button extending outwardly from said first end of said handle portion;

a spring means in said first bore of said handle portion which yieldably maintains said push rod in said first position;

a brush head including a ferrule having an inverted, truncated conical-shaped portion, having first and second ends, and a portion at said first end of said inverted truncated conical-shaped portion thereof;

said ferrule having a plurality of bristles received therein which extend outwardly therefrom;

a detent assembly including first and second ends;

said detent assembly having a first portion, having first and second ends; which is received by said oval portion of said ferrule;

said detent assembly also having a second portion at said first end of said first portion which has a diameter less than said first portion of said detent assembly to form a shoulder at the juncture of said first and second portions thereof;

said detent assembly also having an inverted, conical-shaped portion, having first and second ends, which extends from said first end of said second portion thereof;

said detent assembly having a detent ball at said first end of said inverted, conical-shaped portion thereof;

said brush head being selectively removably attachable to said clamping member;

said detent ball extending through said socket receiving portion of said clamping member when said brush head is attached to said clamping member;

said shoulder of said detent assembly engaging said outer end of said second wall portion of said clamping member when said brush head is attached to said clamping member;

said second portion of said detent assembly being received by said second wall portion of said clamping member when said brush head is attached to said clamping member;

said inverted conical portion of said detent assembly being in engagement with said inner wall surface of said inverted conical-shaped wall portion of said clamping member when said brush head is attached to said clamping member;

said tip portion of said push rod being movable into engagement with said detent ball to push said detent ball out of engagement with said socket receiving portion to disconnect said brush head from said handle portion when said push rod is moved, by inward movement of said actuator button with respect to said first bore of said handle portion, from said first position to said second position.

3. A make-up brush, comprising:

an elongated handle portion having first and second ends;

said handle portion having an elongated, longitudinally extending first bore formed therein, having open first and second ends, extending therethrough a generally hour-glass shaped clamping member having first and second ends;

said clamping member including:

(a) a generally truncated conical-shaped wall portion having a first end, a second end, an inner wall surface and an outer wall surface;

(b) an inverted truncated, generally conical-shaped wall portion having a first end, a second end, an inner wall surface and an outer wall surface;

(c) said first end of said inverted truncated, conical-shaped wall portion being joined to said second end of said truncated, conical-shaped wall portion to form a generally circular socket receiving portion;

said clamping member being positioned in said second end of said bore; an elongated push rod having first and second ends;

said push rod selectively movably positioned in said first bore;

said push rod being longitudinally movable in said bore between first and second positions;

said second end of said push rod having a tip portion extending therefrom;

said tip portion of said push rod being spaced from said socket receiving portion when said push rod is in said first position;

said tip portion of said push rod extending into said socket receiving portion when said push rod is in said second position;

an actuator button, having outer and inner ends, positioned in said first end of said bore;

said actuator button being selectively longitudinally movable in first bore of said handle portion;

said inner end of said actuator button being secured to said first end of said push rod;

said outer end of said actuator button extending outwardly from said first end of said handle portion;

a spring means in said bore of said handle portion which yieldably maintains said push rod in said first position;

a brush head including a ferrule having an inverted, truncated conical-shaped portion, having first and second ends, said ferrule having a plurality of bristles received therein which extend outwardly therefrom;

a detent assembly including first and second ends;

said detent assembly having an inverted, conical-shaped portion having first and second ends;

said detent assembly having a detent ball at said first end of said inverted, conical-shaped portion thereof;

said brush head being selectively removably attachable to said clamping member;

said detent ball being positioned in said socket receiving portion of said clamping member when said brush head is attached to said clamping member;

said inverted conical portion of said detent assembly being in engagement with said inner wall surface of said inverted conical-shaped wall portion of said clamping member when said brush head is attached to said clamping member;

said tip portion of said push rod being movable into engagement with said detent ball to push said detent ball out of engagement with said socket receiving portion to disconnect said brush head from said handle portion when said push rod is moved, by inward movement of said actuator button with respect to said bore of said handle portion, from said first position to said second position.

* * * * *